United States Patent [19]

Gau

[11] 4,072,555

[45] Feb. 7, 1978

[54] LABEL EXTRACTING AND TRANSFERRING DEVICE

[75] Inventor: Georg Gau, Obertraubling, Germany

[73] Assignee: Hermann Kronseder, Worth, Donau, Germany

[21] Appl. No.: 636,499

[22] Filed: Dec. 1, 1975

[30] Foreign Application Priority Data

Dec. 20, 1974 Germany ..... 2460459

[51] Int. Cl.[2] ..... B65C 9/08

[52] U.S. Cl. ..... 156/571

[58] Field of Search ..... 156/570–572

[56] References Cited

U.S. PATENT DOCUMENTS

| | | | |
|---|---|---|---|
| 1,681,413 | 8/1928 | Kronquist | 156/571 |
| 3,450,591 | 6/1969 | Zodrow | 156/570 |
| 3,736,213 | 5/1973 | Jorss et al. | 156/570 |
| 3,865,671 | 2/1975 | Kronsder | 156/572 |
| 3,869,331 | 3/1975 | Saso | 156/571 |
| 3,893,388 | 7/1975 | Kronsder | 156/571 |
| 3,923,589 | 12/1975 | Tauernier | 156/571 |

*Primary Examiner*—Douglas J. Drummond
*Attorney, Agent, or Firm*—Joseph P. House, Jr.

[57] ABSTRACT

A rotary label extracting carrier picks up glue from a glue roller and applies the glue to the back of the frontal label in a label magazine. The label extracting carrier picks up the frontal label with the glue and carries the glued label to a gripper cylinder having gripper fingers which grip the leading edge of glued label and peel it off the label extracting carrier for transfer to a bottle or other object. The circular pitch of the gripper cylinder is smaller than the circular pitch of the label extracting carrier, and the label extracting carrier is rotated synchronously with the gripper cylinder in such manner that the peripheral speed of the label extracting carrier is greater than the peripheral speed of the gripper cylinder. This arrangement produces a smooth peeling action of the labels as they are transferred from the label extracting carrier to the gripper cylinder and thereby substantially eliminates crushing and tearing of the labels.

5 Claims, 11 Drawing Figures

LABEL EXTRACTING AND TRANSFERRING DEVICE

BACKGROUND OF THE INVENTION

This invention relates to a label extracting device for taking the labels out of a label magazine and transferring them to a uniformly rotating gripper cylinder with cam controlled gripper fingers and corresponding gripper pads. The label extracting device consists of a carrier which rotates around a stationary axis and has several segments, each movable around an axis of oscillation relative to the carrier, and each having a gluable sticking surface lying eccentrically to the axis of oscillation. The segments are controlled in such a way that they rotate relative to the carrier to roll off the frontal label in the magazine. The segments stand still relative to the carrier when they are being glued by a glue roller and when the grippers of the gripper cylinder strip off the labels. In the latter cases, the sticking surfaces lie concentrically with the axis of the carrier.

A device of the above-described type is already known in which the circular pitch and peripheral speed of the carrier sticking surface and gripper cylinder are both equal. The disadvantage of the prior art device is that the segments have to be arranged with large distance from each other because of their relatively extensive movement. The circular pitches of the label carrier and gripper cylinder are therefore relatively large and require a corresponding large distance between the objects to be labeled and high operating speed.

To avoid this disadvantage, it is already well known to attach two carriers with segments and a label magazine each to the gripper cylinder. In this way a very small circular pitch can be achieved on the gripper cylinder but a much higher construction cost must be accepted.

Furthermore, there are different prior art extracting devices with cylindrical glue pallets known which rotate around their center axis and which are swingable relative to a carrier around another axis. The circular path and the peripheral speed of the pallets can be accommodated to the form and speed of the label magazine, glue roller and gripper cylinder by means of corresponding regulation of autorotation and swinging of the pallets. The control devices needed for such regulation are complicated and troublesome, they require a number of gear elements, bearings, etc., and therefore lead to extremely expensive construction. Accordingly, this construction cannot be used in a cheap and reliable labeler.

SUMMARY OF THE INVENTION

An important object of this invention is to provide a label extracting device in which its operating speed is substantially reduced without reducing its capacity and without additional expense. A further object of this invention is to provide an inexpensive and reliable label extraction and transferring device.

One technique of the present invention in achieving these objects is to make the circular pitch of the gripper cylinder smaller than the circular pitch of the carrier sticking surfaces and to rotate the gripper cylinder concurrently with the carrier in such a way that the peripheral speed of the label extracting carrier sticking surfaces is greater than the peripheral speed of the gripper cylinder. Accordingly, after the label gripper on the carrier grips the leading edge of the label on the carrier pad, the carrier pad will be rotating slightly faster than the gripper cylinder and will tend to overtake it, thus to cause a sharper and ever increasing bend in the label as it is peeled from the sticking surface on the pad and facilitate the peeling action without tearing or crushing the label.

The foregoing arrangement will improve operations even when the grippers close on the leading edge of the label when it is nearest the gripper pad. There should be an appreciable gap at this point so that the closing movement of the gripper finger will lift the leading edge of the label off of the pad and create a peeling bend in the label. However, further improvement is achieved in accordance with the present invention by delaying the closing of the gripper finger on the leading edge of the label until it has passed its point of nearest approach to the gripper pad and has started to widen the gap therebetween. By delaying the actuation of the gripper finger as aforesaid, the action of the gripper finger in wiping the leading edge of the label across the slightly widened gap will peel the leading margin of the label from the sticking surface of the carrier pad and produce a sharper bend in the label to enhance its peeling action from the pad.

The term "pitch" is defined in the labeling machine art by the distance between the label centerlines or the center axis of the objects to be labeled, measured along their path of motion. The pitch of the rotating label extraction carrier is the distance between the leading edges of successive carrier pads. The pitch of the gripper cylinder is the distance between the leading edges of two adjacent gripper pads.

It is also advantageous in accordance with another aspect of this invention that the ends of the gripper fingers are rounded. The rounded gripper fingers facilitate gripping and avoid breaks in the labels.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
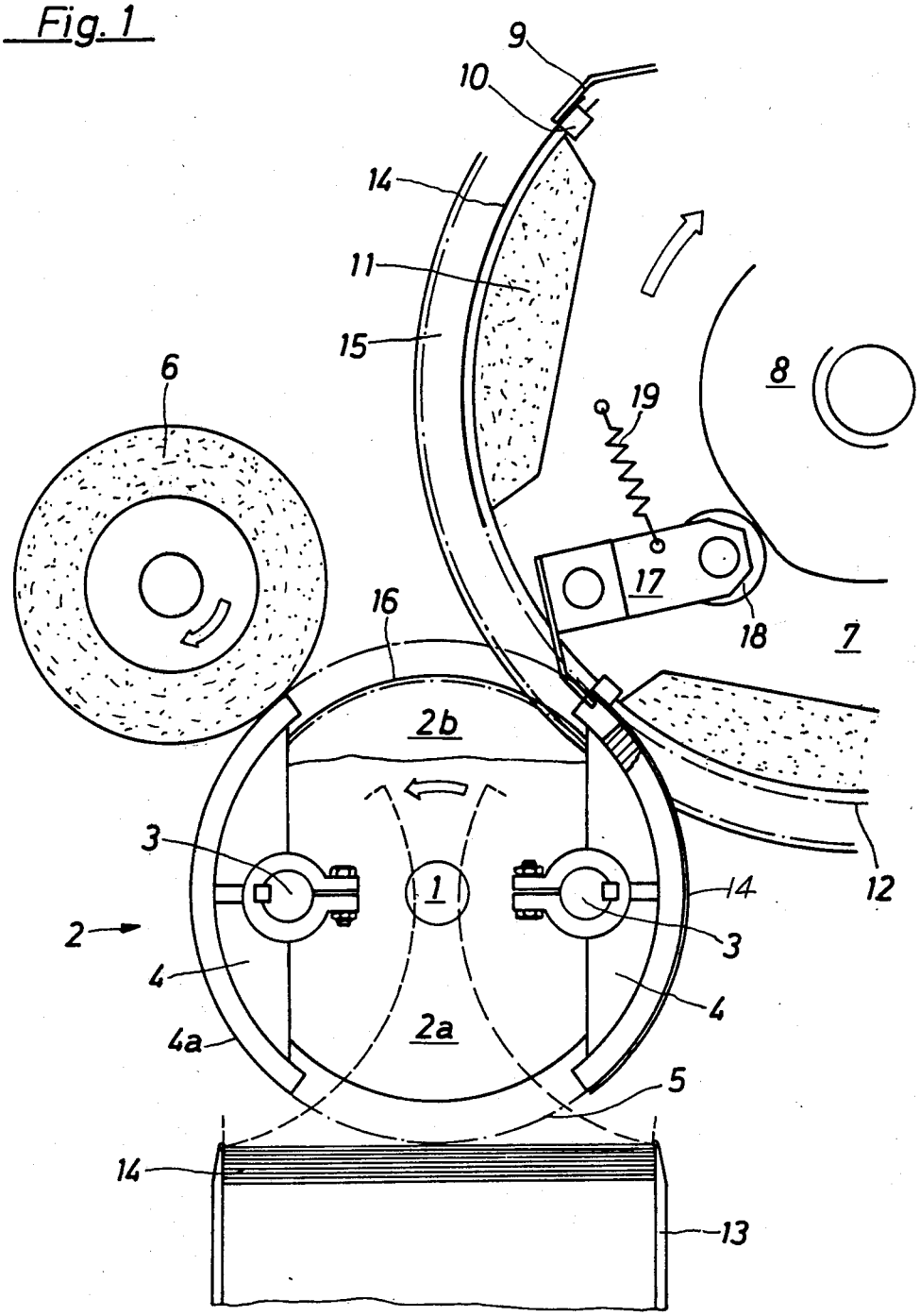
FIG. 1 is a diagrammatic fragmentary plan view of an extracting and transferring device for labels.

The device shown in FIG. 1 is equipped with a label transfer or extraction carrier 2, rotatably mounted around a stationary axis 1. Carrier 2 consists of an upper plate 2*a*, a lower plate 2*b* and a hub (not shown) which connects the two plates with each other. In the two plates 2*a* and 2*b* two shafts 3 are rotatably mounted about two axes lying diametrically opposite each other with the same distance from the center axis 1 of the carrier 2. On shafts 3, label transfer pads or segments 4 are clamped by means of conventional screws and wedges. Segments 4 are equipped with semi-cylindrical sticking surfaces 4*a* which are carried on axes eccentric with respect to the axis of oscillation defined by shaffts 3. The radius of curvature of the sticking surface 4*a* is equal to the sum of distances between the axis of oscillation of shaft 3 and the axis of rotation 1 of the carrier and the shortest distance between the sticking surface 4*a* and the axis of oscillation of shaft 3. This radius of curvature corresponds with the radius of the circumference of the carrier 2, as it is defined by the segments 4 in their middle position, e.g., when segments 4 are lying concentrically to the axis of rotation 1 of the carrier. This circumference is numbered 5 in FIG. 1.

The shafts 3 with segments 4 are driven in an oscillatory manner by conventional apparatus (not shown).

Adjacent the circumference of the carrier 2 a glue roller 6 with a stationary axis of rotation is arranged for applying a coating of glue to the sticking surfaces 4*a*. A gripper cylinder 7 rotates around a stationary axis of rotation with its periphery adjacent to the periphery of carrier 2. The gripper cylinder 7 has gripper fingers 9 controlled by a stationary cam 8. Gripper cylinder 7 has a series of pads 11 against which transferred labels 14 lie. At the leading edge of each pad 11 is a gripper pad 10. The gripper fingers 9 are pivotally mounted on gripper cylinder 7 and are connected to levers 17 which bear against cam 8 by means of a roller 18 which is fastened on lever 17. An expansion spring 19 is connected to lever 17 and urges gripper finger 9 to close and keep cam roller 18 in touch with the cam 8. Cam 8 is shaped to produce the gripping sequence or phases illustrated in FIGS. 2*a* through 2*f*. The sponge rubber cushions 11 are slightly recessed compared to the circumference 12 of the gripper cylinder 7 defined by the pads 10. Rubber cushions 11 serve to press the labels 14 against the objects (not shown) to which the labels are applied.

A stationary label magazine 13 is mounted adjacent to the circumference of the carrier 2. The foremost label 14 in magazine 13 is tangent to the periphery 5 of carrier 2.

The apparatus is constructed in such a way that the carrier pad segments 4 with sticking surfaces 4*a* roll on the foremost or frontal label 14 in the label magazine container 13 and thereby extracts the frontal label 14 by means of adhesion. The beginning and end positions of an extracting oscillation of segments 4 are shown in broken lines in FIG. 1. After the extracting oscillation, the segments 4 with the sticking surfaces 4*a* are oscillated back into the circumference 5. Segments 4 remain in this position while the labels 14 are transferred and while being glued until segments 4 are returned to the beginning position shortly before extraction.

As shown in FIG. 1, the pitch of the rotating carrier 2, i.e., the distance between the leading edges of successive pads 4*a* on the circumference 5, is larger than the pitch of the gripper cylinder 7, i.e., the distance between the leading edges of successive gripper pads 10 on the circumference 12. Therefore, the distance between the labels 14 on the gripper cylinder 7 is less than the distance between labels 14 on the carrier 2. To make sure that the leading edge of each carrier pad 4*a* always meets the corresponding gripper pad 10, the peripheral speed of the carrier 2 is higher than the peripheral speed of the gripper cylinder 7. The peripheral speeds of the carrier 2 and gripper cylinder 7 are related in the same way as their pitches. The circumferences 5 and 12 do not roll on each other, but rather slide.

The synchronous or concurrent drive of gripper cylinder 7 and carrier 2 is effected by a toothed wheel 15 which is connected on the driving shaft of the gripper cylinder 7 and by a meshing toothed rim 16 which is mounted on the lower plate 2*b* of the carrier 2. The gear ratio between toothed wheel 15 and toothed rim 16 is chosen in such a way that the peripheral speeds mentioned above are realized. The glue roller 6 is driven by other conventional toothed wheels (not shown) synchronously with the peripheral speed of carrier 2.

Different phases or stages in the label transferring process or sequence are shown in FIGS. 2*a* through 2*f*. Broken line 20 extends between the axes of rotating of carrier 2 and gripper cylinder 7.

Figure 2A:
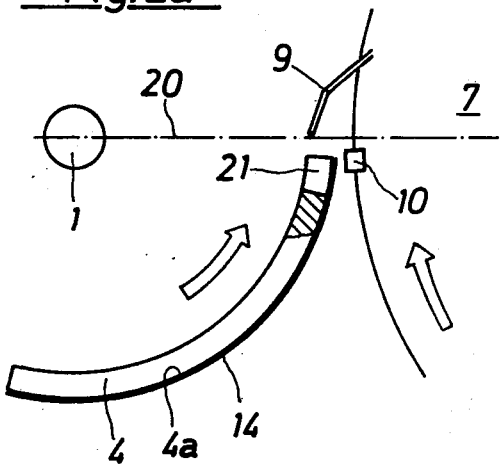
FIGS. 2*a* through 2*f* are diagrammatic fragmentary views showing different phases of a label transferring process of the device shown in FIG. 1.
Figure 2B:
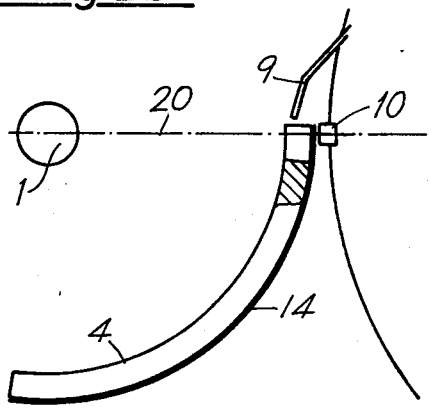
Figure 2C:
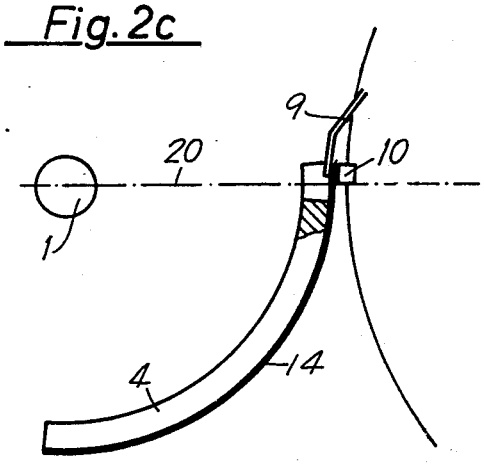

In the position shown in FIG. 2*a*, the carrier pad sticking surface 4*a* and the gripper pad 10 approach to the zone of their smallest mutual separation distance or gap. The gripper finger 9 is open completely at this time. The position of the smallest mutual separation distance or gap is reached in FIG. 2*b*. The centerline of the gripper pad 10 coincides with the straight line 20 at this time. The distance between the sticking surface 4*a* and the gripper pad 10 is slightly greater than the label thickness, so that there is still no contact between label 14 and gripper pad 10 at this time. In FIG. 2*b* the gripper finger 9 has already been moved a little in order to close. However, it does not touch the label 14 at this time. With further rotation of carrier 2 and gripper cylinder 7, the sticking surface 4*a* and gripper finger 9 move to the position shown in FIG. 2*c*, whereby the distance between them has increased. At this time, the gripper finger 9 is nearly closed completely but the label 14 can still move freely between gripper finger 9 and gripper pad 10. The gripper finger 9 is now in a recess 21 which is formed in the segments 4 in the area of the gripper finger 9 in a known way. Because of cooperation of the closing movement of the gripper finger 9 and overtaking of the sticking surface 4*a* opposite the gripper pad 10, the leading edge of the label 14 is lightly lifted or peeled from the sticking surface 4*a* and is disposed between gripper finger 9 and gripper pad 10.

Figure 2D:
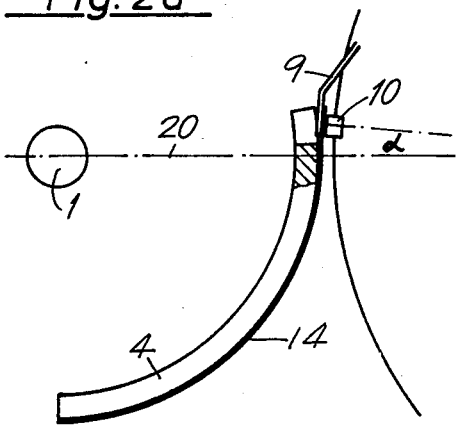

The gripper finger 9 is closed completely in the position shown in FIG. 2*d*. The label is clamped between gripper finger 9 and gripper pad 10 and it is lifted from the sticking surface on the edge. The angle alpha between the straight line 20 and the center line of the gripper pad 10 is about 4°.

Figure 2E:
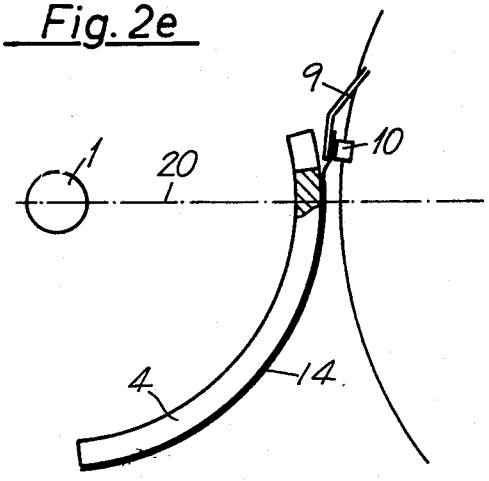
Figure 2F:
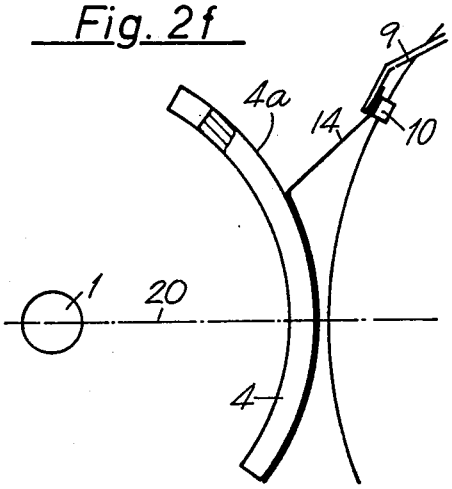

With further rotation of gripper cylinder 7 and carrier 2, the label is bent in steps as shown in FIG. 2*e*. Because of this bending of the label, the different peripheral speeds of gripper cylinder 7 and carrier 2 will be compensated for without disadvantageous effect. The label 14 is peeled off more and more from the overtaking sticking surface 4*a* by the gripper cylinder 7 (FIG. 2*f*). The peel-off line gets farther away from the straightline 20. After its complete removal, the label 14 is only held by the gripper finger 9 and finally enters the labeling station where it is pressed against a bottle or other object (not shown) and where the gripper fingers are opened.

Figure 3A:
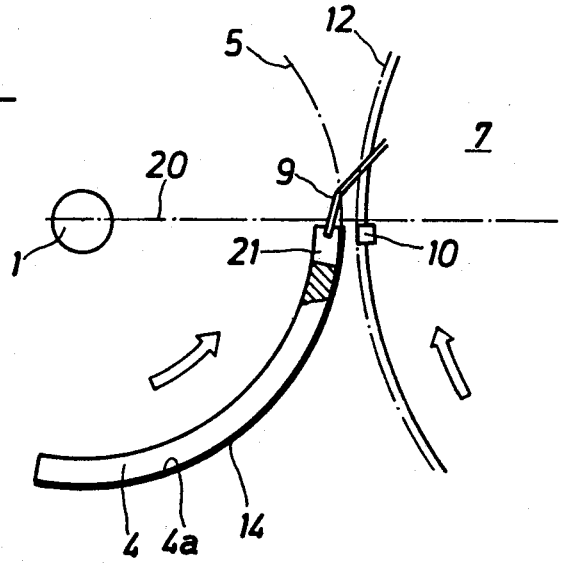
FIGS. 3*a* and 3*b* are diagrammatic fragmentary views showing different phases of a transferring process in a modification of the device shown in FIG. 1.
Figure 3B:
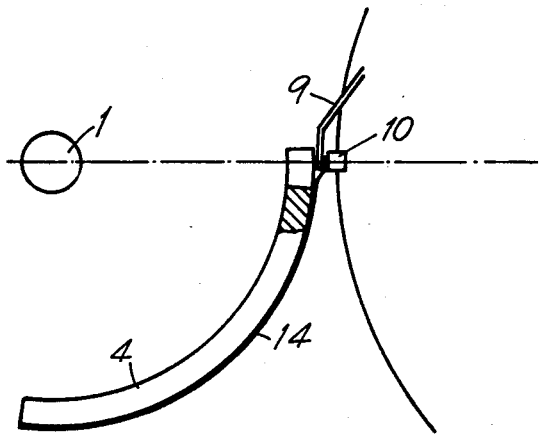

As compared to the device shown in FIG. 1, in which the smallest distance between sticking surfaces 4*a* and gripper pads 10 is only slightly larger than the thickness of the label material, this distance can just as well be larger, preferably in the area of a few millimeters. In this case, it is possible to have the gripper fingers 9 closed at the point when sticking surfaces 4*a* and gripper pads 10 are closest together. FIGS. 3*a* and 3*b* show phases in the transferring process of such a modified device.

In the position shown in FIG. 3*a*, the carrier sticking surface 4*a* and the gripper pad 10 approach to the area of the smallest mutual separation distance. The gripper finger 9 is already partly closed here, but does not yet touch the label 14. Subsequently, sticking surface 4*a* and gripper pad 10 get into the area of closest approach in which the centerline of the gripper pads coincide with the straight line 20. Then the gripper finger 9 is closed completely as shown in FIG. 3*b*. Because of the relatively large distance between gripper pad 10 and sticking surface 4*a*, the label 14 is lifted from the sticking surface 4*a* on its frontal edge and it slides a little between gripper finger 9 and gripper pad 10. Therefore and because of the overtaking of the sticking surface 4*a* at the same time, the label is bent steplike. Further transferring process of the label 14 corresponds with that shown in FIG. 2*f*. In this case a regulated peeling of the label 14 occurs in order to compensate for the relative movement of gripper cylinder 4*a* and carrier 2.

Figure 4A:
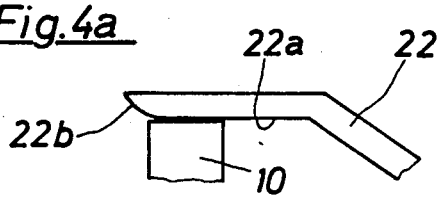
FIGS. 4*a* and 4*b* are diagrammatic fragmentary views showing alternate gripper fingers which can be used in the device shown.
Figure 4B:
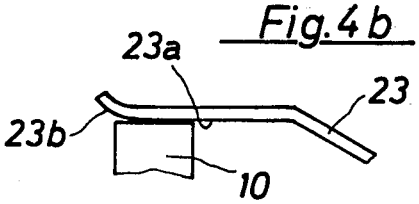

Two especially advantageous kinds of construction of the gripper fingers 9 are shown in FIG. 4*a* and 4*b*. The gripper finger 22 (FIG. 4*a*) is provided with a rounded nose 22*b* on its end which continues seamlessly in its working area 22*a*. The gripper finger 23 (FIG. 4*b*) is bent off on the end of its working area 23*a* away from the gripper pad 10 so that a rounded nose 23*b* is formed which continues seamlessly into the working area. Instead of rounding, a slope can also be employed.

What is claimed is:

1. In a label extracting and transferring device having a label magazine, a label extracting carrier having arcuately shaped extraction pads, said carrier being rotatably mounted adjacent to said label magazine for extracting labels therefrom, means for coating adhesive over the surfaces of the extraction pads whereby labels extracted thereby from the magazine will stick to the pad surfaces, and a gripper cylinder having arcuately shaped gripper pads, said cylinder being rotatably mounted adjacent to said label extracting carrier for transferring said labels from said carrier to said gripper cylinder, the improvement including means for concurrently rotating said gripper cylinder and label extracting carrier in such manner that the peripheral speed of said label extracting carrier is greater than the peripheral speed of said gripper cylinder, thereby causing the label extracting carrier to tend to overtake the gripper cylinder during mutual rotation thereof, the arcuate surface of the extraction pads diverging from the arcuate surface of the gripper pads to develop a sharp bend in the label to promote peeling it from the adhesive coated surface of the extraction pads as the carriers rotate.

2. The label extracting and transferring device of claim 1 in which said gripper cylinder includes gripper fingers adjacent opposing gripper pads against which said gripper fingers can be closed, and cam means for opening and closing said gripper fingers with respect to said gripper pads, and wherein said cam means is shaped to cause said gripper fingers to close after the corresponding gripper pads have moved past their point of nearest approach to the peripheral surface of said label extracting carrier.

3. The label extracting and transferring device of claim 1 in which said label extracting carrier and gripper cylinder are positioned to provide a space between their respective peripheries which is greater than the thickness of one of said labels, and wherein said gripper cylinder includes gripper fingers adjacent opposing gripper pads against which said gripper fingers can be closed, and cam means for opening and closing said gripper fingers with respect to said gripper pads, and wherein said cam means is shaped to cause said gripper fingers to close when the corresponding gripper pads reach their point of nearest approach to the peripheral surface of said label extracting carrier.

4. The label extracting device of claim 1 wherein said gripper fingers are rounded on their ends to help prevent damage to said labels.

5. The device of claim 1 in which the pitch of said gripper cylinder is smaller than the pitch of said label extracting carrier.

* * * * *